US008084963B2

(12) United States Patent
Chandler et al.

(10) Patent No.: US 8,084,963 B2
(45) Date of Patent: Dec. 27, 2011

(54) MANAGEMENT OF RECHARGEABLE BATTERY IN AN ENCLOSED LIGHTING MODULE

(75) Inventors: Lance Chandler, Toutle, WA (US); Jim Scalf, Salem, OR (US); Thomas L. Downer, Ocean Park, WA (US); Laurence G. Teeter, Jr., Clarksville, TN (US); Thomas T. Teeter, Guthrie, KY (US)

(73) Assignee: Innovative Engineering & Product Development, Inc., Toulte, WA (US)

( * ) Notice: Subject to any disclaimer, the term of this patent is extended or adjusted under 35 U.S.C. 154(b) by 449 days.

(21) Appl. No.: 12/415,898

(22) Filed: Mar. 31, 2009

(65) Prior Publication Data

US 2010/0244747 A1 Sep. 30, 2010

(51) Int. Cl.
*H05B 39/00* (2006.01)
*F21V 33/00* (2006.01)

(52) U.S. Cl. ..... 315/313; 315/291; 315/362; 340/636; 340/635; 340/661; 307/66; 307/64; 362/253

(58) Field of Classification Search ..... 315/313, 315/86, 119–120, 129–133, 159, 160, 175, 315/291, 362; 362/253; 340/635, 636, 661; 307/64, 66

See application file for complete search history.

(56) References Cited

U.S. PATENT DOCUMENTS

| | | | | |
|---|---|---|---|---|
| 5,751,217 | A | 5/1998 | Kchao et al. | |
| 6,285,132 | B1 * | 9/2001 | Conley et al. | 315/86 |
| 6,924,688 | B1 * | 8/2005 | Beigel | 327/330 |
| 7,001,047 | B2 | 2/2006 | Holder et al. | |
| 7,059,743 | B2 | 6/2006 | Niemann | |
| 7,150,540 | B2 | 12/2006 | Kovacik et al. | |
| 7,325,944 | B2 | 2/2008 | Kovacik et al. | |
| 2006/0139003 | A1 | 6/2006 | Fischer et al. | |
| 2007/0194722 | A1 | 8/2007 | Bruekers et al. | |
| 2010/0172384 | A1 * | 7/2010 | Groepl | 372/38.04 |

FOREIGN PATENT DOCUMENTS

KR 20010055170 7/2001

OTHER PUBLICATIONS

PCT International Search Report and Written Opinion for PCT/US2010/029107 mailed Oct. 26, 2010.

* cited by examiner

*Primary Examiner* — Vibol Tan
(74) *Attorney, Agent, or Firm* — Schwabe, Williamson & Wyatt, P.C.

(57) ABSTRACT

Embodiments of the present disclosure provide methods, systems, and apparatuses related to managing a rechargeable battery in an enclosed lighting module. Other embodiments may be described and claimed.

16 Claims, 4 Drawing Sheets

MANAGEMENT OF RECHARGEABLE BATTERY IN AN ENCLOSED LIGHTING MODULE

FIELD

Embodiments of the present disclosure relate to the field of lighting, and more particularly, to managing a rechargeable battery in an encased lighting module.

BACKGROUND

Multi-chemistry rechargeable batteries are used in a variety of applications. Often the lifetimes of these batteries could include a large number of charge/discharge cycles. However, the conditions in which these batteries are deployed and the way in which they are managed could result in a large variability of battery lifetimes.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

In the following detailed description, reference is made to the accompanying drawings which form a part hereof wherein like numerals designate like parts throughout, and in which is shown by way of illustration embodiments in which the disclosure may be practiced. It is to be understood that other embodiments may be utilized and structural or logical changes may be made without departing from the scope of the present disclosure. Therefore, the following detailed description is not to be taken in a limiting sense, and the scope of embodiments in accordance with the present disclosure is defined by the appended claims and their equivalents.

Various operations may be described as multiple discrete operations in turn, in a manner that may be helpful in understanding embodiments of the present disclosure; however, the order of description should not be construed to imply that these operations are order dependent.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

Various components may be introduced and described in terms of an operation provided by the components. These components may include hardware, software, and/or firmware elements in order to provide the described operations. While some of these components may be shown with a level of specificity, e.g., providing discrete elements in a set arrangement, other embodiments may employ various modifications of elements/arrangements in order to provide the associated operations within the constraints/objectives of a particular embodiment.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

Figure 1A:
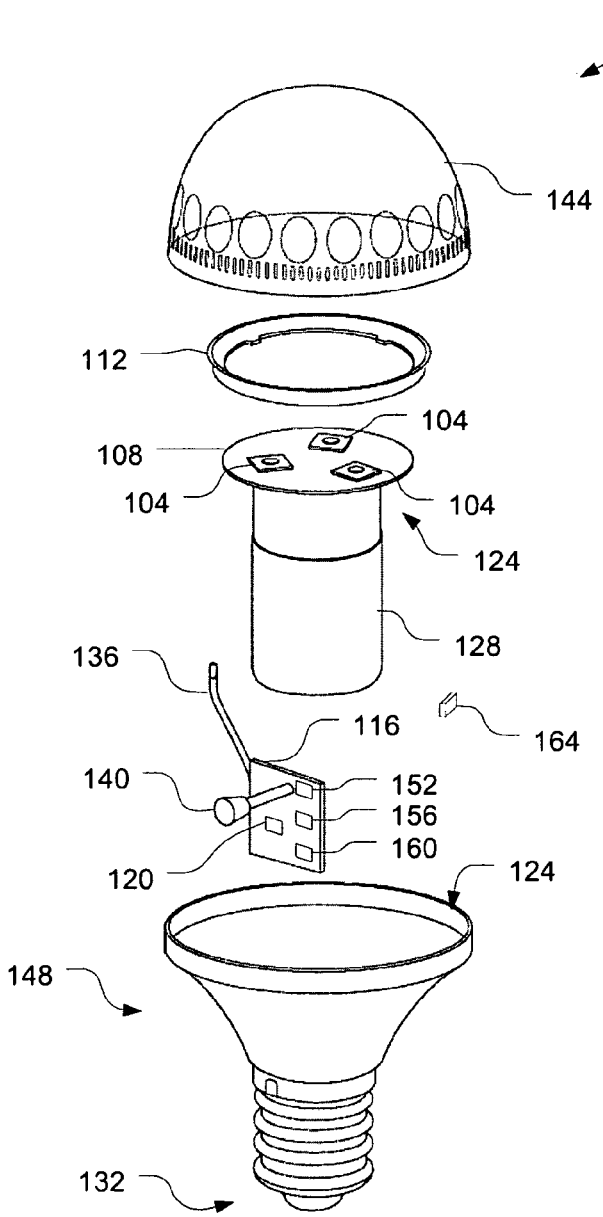
FIGS. 1*a* and 1*b* respectively illustrate exploded and assembled views of a lighting module in accordance with embodiments of this disclosure.
Figure 1B:
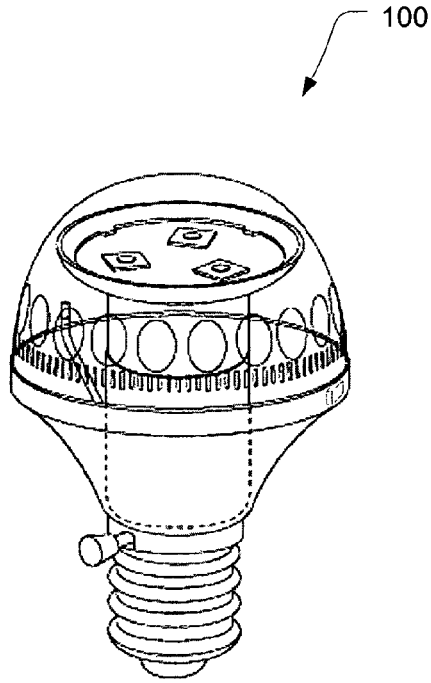

FIGS. 1*a* and 1*b* illustrate a lighting module 100 in an exploded view and an assembled view, respectively, in accordance with some embodiments. The lighting module 100 may include one or more light emitting diodes (LEDs) 104 coupled to a mounting board 108 that provides power connections to the LEDs 104. While three LEDs 104 are shown, other embodiments may have any number of LEDs. A lens reflector 112 may be placed around a perimeter of the mounting board 108 to provide a desired optical effect.

The lighting module 100 may also include a circuit board 116 that may house and interconnect various electrical components of the lighting module 100 including, but not limited to, a controller 120. The controller 120 may be coupled to a direct current (DC) power supply interface 124 that is configured to be coupled to a rechargeable battery 128 (hereinafter "battery 128"), which may be a multi-chemistry rechargeable battery. In some embodiments, the battery 128 may be removably coupled to the DC power supply interface 124 in order to be easily replaced at the end of its effective life. In other embodiments, the battery 128 may be permanently coupled to the DC power supply interface 124. In these embodiments, the entire lighting module 100 may be replaced, rather than just the battery 128, at the end of the effective life of the battery 128.

As used herein, "removably coupled elements" are elements in which the coupling design allows a user of the device to couple/decouple the elements in the ordinary course of operation; while "permanently coupled elements" are elements in which the coupling design does not allow the user of the device to couple/decouple the elements in the ordinary course of operation.

The controller 120 may also be coupled to an alternating current (AC) power supply interface 132 that is configured to be coupled to an AC power supply through, e.g., a standard lighting fixture. The AC power supply interface 132 may be an Edison screw base, of any size, as is generally shown. In other embodiments, the AC power supply interface 132 may be any other type of light bulb connector or power connector, e.g., power plug.

When power is present at the AC power supply interface 132, the controller 120 may use the AC power to power the LEDs 104 and to recharge the battery 128, as will be described in more detail below. When AC power is not present at the AC power supply interface 132, the controller 120 may use the DC power from the battery 128 to power the LEDs 104. Providing backup power from the battery 128 may allow the lighting module 100 to work independent of an available AC power system. This may allow the lighting module 100 to provide a portable and/or auxiliary light source (e.g., a light source to be used when a power outage occurs in a building's electrical network).

When operating as an auxiliary light source, the lighting module 100 may detect AC power in an electrical network to which it is communicatively coupled. The lighting module 100 may be communicatively coupled to the electrical network by a direct electrical connection, e.g., by a lighting fixture plugged into an outlet, or wirelessly. The lighting module 100 may include an antenna 136 and a resonant circuit in an embodiment in which it is configured to wirelessly detect AC power in a proximally-disposed electrical network as is described in co-pending application titled LIGHTING MODULE WITH WIRELESS ALTERNATING CURRENT DETECTION SYSTEM filed contemporaneously with the present application. The specification of said application is hereby incorporated in its entirety except for those sections, if any, that are inconsistent with the present specification.

The lighting module 100 may also include a state switch 140 coupled to the controller 120 through the circuit board 116. The state switch 140 may be operated to change between various operating states of the lighting module 100. For example, in one embodiment the lighting module 100 may have two states. In a first state, the lighting module 100 may function as an auxiliary light. That is, the LEDs 104 are activated when AC power is not detected in an electrical network to which the lighting module 100 is communicatively coupled. In a second state, the LEDs 104 may be activated, regardless of the presence/absence of AC power in the electrical network. In other embodiments, additional and/or alternative states may be provided.

The components of the lighting module 100, including the battery 128 when it is coupled to the DC power supply interface 124, may be disposed within an enclosure defined, at least in part, by a bulb-shaped, light passable body 144 (hereinafter "body 144") and a base 148, which may include the AC power supply interface 132. The lighting module 100 may include a temperature sensing device 152 that is coupled to the controller 120 to determine a temperature inside of the enclosure. The temperature sensing device 152 is shown as being disposed on the circuit board 116; however, in other embodiments it may be disposed in other locations within the enclosure. Furthermore, in other embodiments, additional temperature sensing devices may be placed throughout the enclosure. For example, one temperature sensing device may be placed near the battery 128 while another temperature sensing device may be placed near the LEDs 104.

Disposing the components of the lighting module 100 within the enclosure, as shown, facilitates use of the lighting module 100 as an interchangeable replacement for conventional light bulbs. However, the confinements of the enclosure may restrict heat dissipation and complicate various charge/discharge analyses of the battery 128. Performing these analyses improperly in such a high-ambient temperature environment may result in early failure of the battery 128 and/or lighting module 100. Accordingly, embodiments of the disclosure described herein present various management techniques and/or analyses that the controller 120 may employ in order to efficiently manage the battery 128 to increase its useful life and more accurately determine and communicate its status.

The controller 120 may be coupled with memory 156, which may be volatile and/or non-volatile memory that stores data that may relate to the operation of the battery 128. The data may include impedance, temperature, current, electric reflectivity, number of cycles, and total coulomb-metric data for the life of the battery 128, etc. The controller 120 may acquire this data from a programming device through a programming interface 160, from one or more sensors of the lighting module 100, e.g., the temperature sensing device 152, and/or from monitoring/testing the operation of the battery 128 itself. The controller 120 may use this data to determine a state of charge and/or a predicted cycle life of the battery 128 as will be described.

The controller 120 may control an indicator LED 164 in a manner to communicate information about the state of charge and/or predicted cycle life of the battery 128. For example, the indicator LED 164 may indicate when the battery 128 will no longer provide a prescribed operating regime for the lighting module 100. The LED 164 may flash to indicate the lighting module 100 and battery 128 should be inspected. The indicator LED 164 may be set to a steady state to indicate that lighting module 100 and battery 128 are functioning properly. In other embodiments, other indication methods, which may include more than one indicator LED, may be employed. For example, in some embodiments, the indicator LED 164 may include an array of LEDs to communicate a level of the charge of the battery 128.

Figure 2:
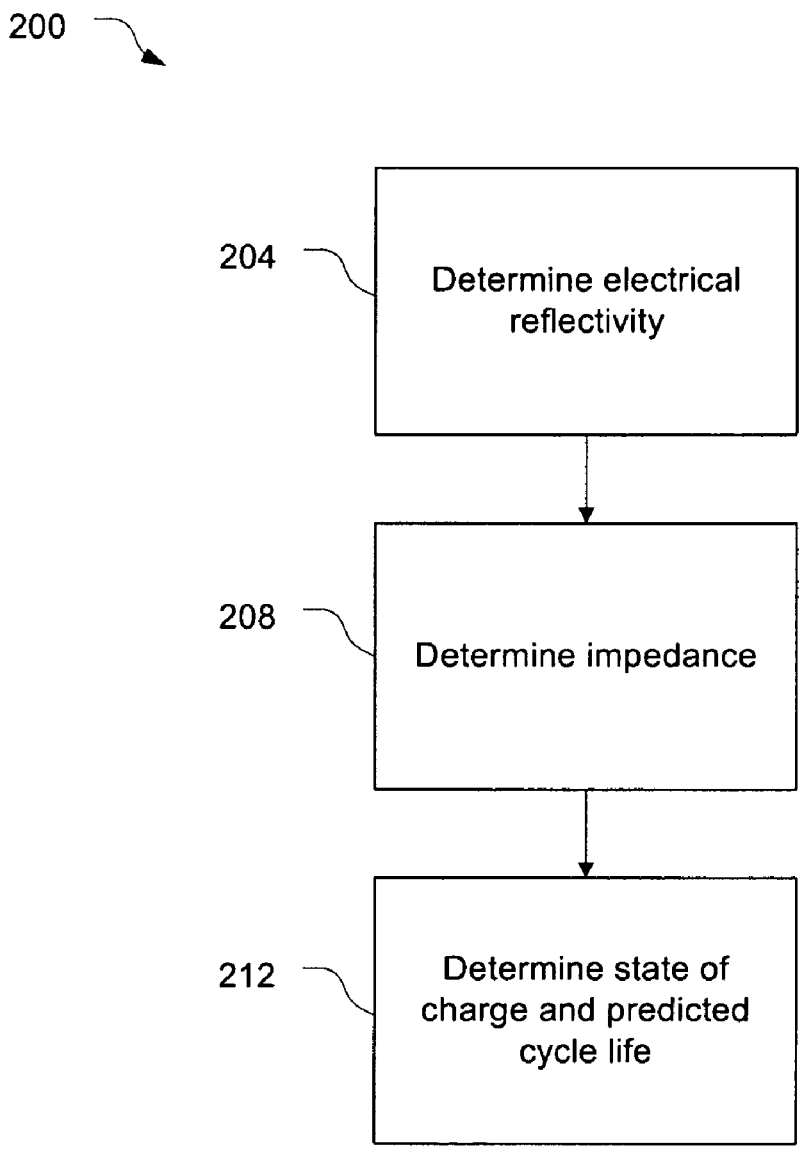
FIG. 2 is a flowchart describing an analysis of a rechargeable battery in accordance with some embodiments.
Figure 3:
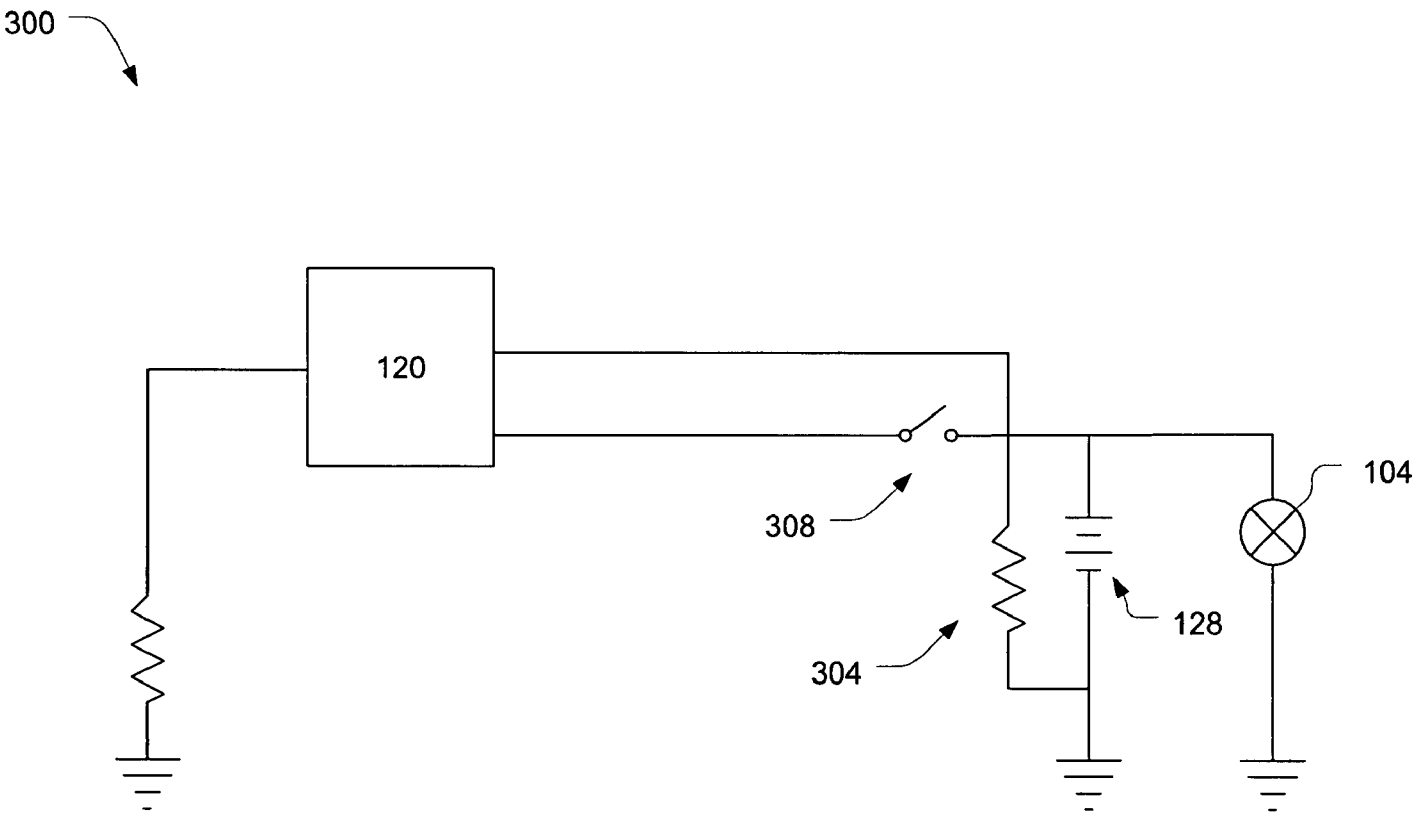
FIG. 3 illustrates a circuit diagram of components of a lighting module in accordance with some embodiments.
Figure 4:
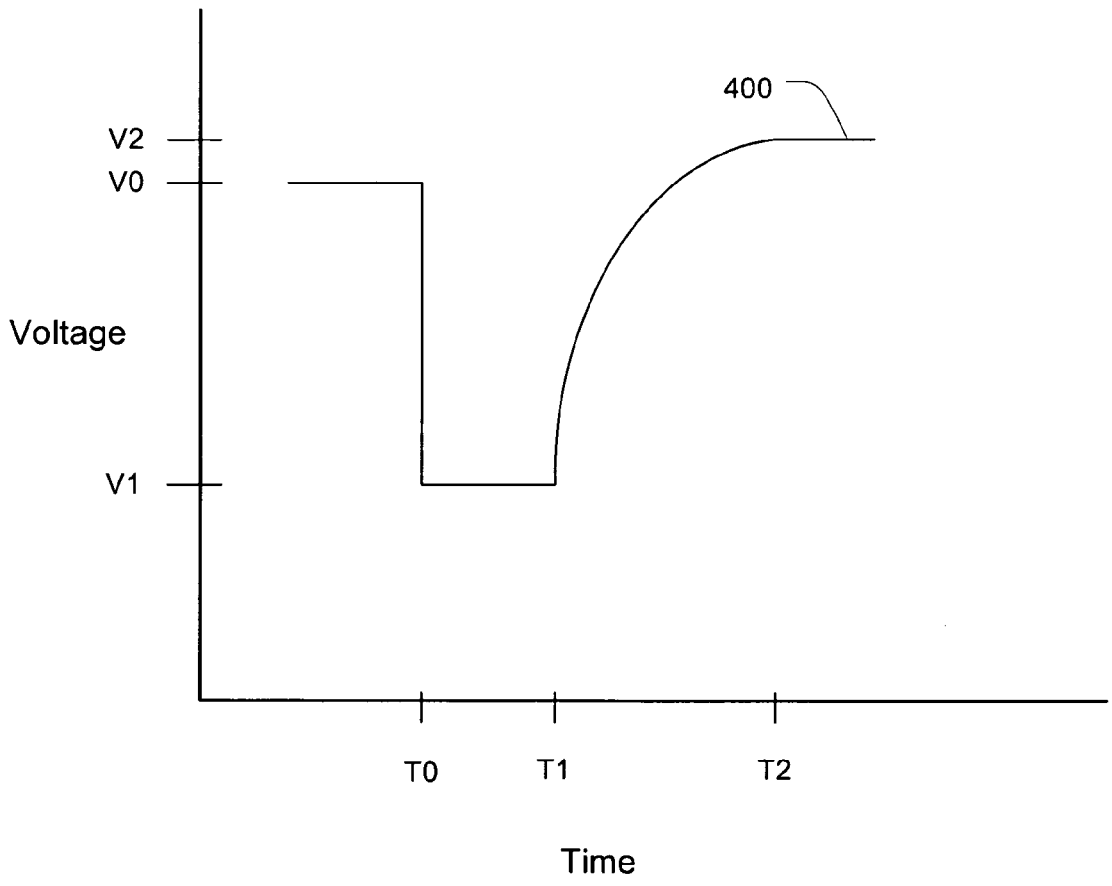
FIG. 4 is a graph of a load line of a battery as a function of voltage and time in accordance with some embodiments.

FIG. 2 is a flowchart showing analysis 200 of the battery 128 in accordance with some embodiments. At block 204, the controller 120 may determine an electrical reflectivity of the battery 128. The determination of the electrical reflectivity may be described with additional reference to FIG. 3, which illustrates a circuit diagram 300 of some of the components of the lighting module 100, and FIG. 4, which is a graph of a load line 400 of the battery 128 as a function of voltage (V) and time (T), in accordance with some embodiments.

At time T0, the controller 120 may couple a load, e.g., a load resistor 304, to the battery 128 by closing a switch 308. This may result in the load line 400 dropping from an initial voltage V0 to an intermediate voltage V1. At time T1, the controller 120 may release the load by opening the switch 308. This may result in the load line 400 recovering until it is at a final voltage V2 at time T2. The electrical reflectivity of the battery 128 may then be determined by measuring the recovery, e.g., (V2−V1)/(T2−T1).

Referring again to FIG. 2, the controller 120 may determine an impedance of the battery 128 at block 208. When the battery 128 is new it may have a full charge approximately equal to its rated capacity. The charge of the battery 128 may be substantially inversely proportional to its impedance. Thus, when new and fully charged, the battery 128 may have a very low impedance. As the battery 128 experiences charge/discharge cycles over the period of its normal use, its effective capacity at full charge may decrease. Accordingly, the full charge impedance may experience a corresponding increase over the life of the battery 128. The controller 120 may determine the impedance of the battery 128 at a certain charge state, e.g., a full charge state.

Having determined the impedance and/or the electrical reflectivity of the battery 128, the controller may determine a state of charge and/or predicted cycle life at block 212. In some embodiments, the controller 120 may determine a state of charge of the battery 128 based at least in part on the determined electrical reflectivity, and may determine the predicted cycle life based at least in part on the determined impedance.

In some embodiments, the controller 120 may determine the state of charge and/or predicted cycle life of the battery 128 by using the determined electrical reflectivity/impedance as indices to reference values in one or more lookup tables stored in memory 156.

As the temperature within the enclosure will affect the impedance of the battery 128, temperature volatility may have a significant impact on the predicted cycle life determination. Accordingly in some embodiments, the controller 120 may determine the impedance and/or determine the predicted cycle life based at least in part on a determined temperature.

In addition to performing the analyses of the battery 128 described above, the controller may also regulate the recharging cycles of the battery 128 in order to enhance its longevity. The battery 128 may have a separator that is placed between its anode and cathode. If the battery 128 is exposed to excessive temperatures, this separator may break down and damage the battery 128 and/or the lighting module 100. Recharging the battery 128, with or without simultaneous operation of the LEDs 104, while it is within the enclosure may accelerate the separator breakdown if not properly managed. Accordingly, the controller 120 may also control the charging of the battery 128 in light of the temperature of the enclosure.

In some embodiments, the controller 120 may determine that the temperature is within one of a plurality of temperature ranges. Each temperature range may be associated with its own recharging duty cycle. Consider, for example, a recharging schedule that provide a 100% recharging duty cycle for a low temperature range; a 60% recharging duty cycle for a medium temperature range; and a 20% recharging duty cycle for a high temperature range. Controlling the recharging of the battery 128 according to this recharging schedule may preserve the integrity of the battery 128 and/or lighting module 100. The controller 120 may access this recharging schedule through the one or more lookup tables stored in memory 156.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present disclosure. Similarly, memory devices of the present disclosure may be employed in host devices having other architectures. This application is intended to cover any adaptations or variations of the embodiments discussed herein. Therefore, it is manifestly intended that embodiments in accordance with the present disclosure be limited only by the claims and the equivalents thereof.

What is claimed is:

1. An apparatus comprising:

a bulb-shaped light-passable body to define, at least in part, an enclosure;

a light emitting diode (LED) disposed within the enclosure;

a power supply interface configured to be coupled to a rechargeable battery in a manner such that the rechargeable battery, when so coupled, is disposed within the enclosure; and a controller disposed within the enclosure and coupled to the LED and the power supply interface, the controller configured to determine an electrical reflectivity of the rechargeable battery;

determine an impedance of the rechargeable battery; and determine a state of charge and a predicted cycle life of the rechargeable battery based at least in part on the electrical reflectivity and impedance.

2. The apparatus of claim 1, wherein the controller is further configured to determine a temperature within the enclosure and to determine the impedance based at least in part on the temperature.

3. The apparatus of claim 1, further comprising:

another power supply interface configured to be coupled to an alternating current (AC) power supply; and the controller is further configured to recharge the rechargeable battery from the AC power supply, when the another power supply interface is coupled to the AC power supply, based at least in part on the temperature.

4. The apparatus of claim 3, wherein the controller is to recharge the rechargeable battery by being configured to determine the temperature is in a first temperature range of a plurality of temperature ranges; and recharge the rechargeable battery according to a first recharging duty cycle of a plurality of recharging duty cycles, the first recharging duty cycle being associated with the first temperature range.

5. The apparatus of claim 3, further comprising an Edison screw base to provide the another power supply interface.

6. The apparatus of claim 1, wherein the controller is configured to determine the electrical reflectivity by being configured to introduce an electrical load to the rechargeable battery, remove the electrical load from the rechargeable battery, and measure a recovery of a voltage of the rechargeable battery as a function of time.

7. The apparatus of claim 1, wherein the controller is configured to determine a state of charge of the rechargeable battery based at least in part on the electrical reflectivity.

8. The apparatus of claim 1, further comprising:

one or more lookup tables; and the controller further configured to determine the state of the charge and/or the predicted cycle life based at least in part on the one or more lookup tables.

9. The apparatus of claim 1, further comprising:

another LED; and the controller is further configured to activate the another LED based at least in part on predicted cycle life.

10. The apparatus of claim 1, further comprising:

the rechargeable battery permanently coupled to the power supply interface.

11. A method comprising:

providing power to a light emitting diode disposed within an enclosure defined, at least in part by a bulb-shaped light-passable body, from a rechargeable battery also disposed within the enclosure;

determining, with a controller disposed within the enclosure, an electrical reflectivity of the rechargeable battery;

determining, with the controller, an impedance of the rechargeable battery; and determining a state of charge and a predicted cycle life of the rechargeable battery based at least in part on the determined electrical reflectivity and impedance.

12. The method of claim 11, wherein said determining the impedance includes:

determining a temperature within the enclosure.

13. The method of claim 11, further comprising:

detecting an presence of an AC power supply;

providing power to the LED from the AC power supply and recharging the rechargeable battery based at least in part on said detecting of the presence of the AC power supply;

detecting an absence of the AC power supply; and said providing power to the LED from the rechargeable battery based at least in part on said detecting the absence of the AC power supply.

14. The method of claim 11, further comprising:

determining a temperature within the enclosure; and recharging the rechargeable battery based at least in part on the temperature.

15. The method of claim 14, further comprising:

determining the temperature is within a first temperature range of a plurality of temperature ranges; and recharging the rechargeable battery according to a first recharging duty cycle of a plurality of recharging duty cycles, the first recharging duty cycle being associated with the first temperature range.

16. The method of claim 11, wherein said determining the electrical reflectivity comprises:

introducing an electrical load to the rechargeable battery, removing the electrical load from the rechargeable battery, and measuring a recovery of a voltage of the rechargeable battery as a function of time.

* * * * *